US012466685B2

(12) United States Patent
Taylor

(10) Patent No.: US 12,466,685 B2
(45) Date of Patent: Nov. 11, 2025

(54) SEAM TAPE TOOL

(71) Applicant: Curtis Taylor, Chagrin Falls, OH (US)

(72) Inventor: Curtis Taylor, Chagrin Falls, OH (US)

( * ) Notice: Subject to any disclaimer, the term of this patent is extended or adjusted under 35 U.S.C. 154(b) by 360 days.

(21) Appl. No.: 17/690,630

(22) Filed: Mar. 9, 2022

(65) Prior Publication Data

US 2022/0289511 A1 Sep. 15, 2022

Related U.S. Application Data

(60) Provisional application No. 63/161,188, filed on Mar. 15, 2021.

(51) Int. Cl.
*B65H 35/00* (2006.01)

(52) U.S. Cl.
CPC ..... *B65H 35/002* (2013.01); *B65H 35/0073* (2013.01); *B65H 2301/5154* (2013.01); *B65H 2701/377* (2013.01)

(58) Field of Classification Search
CPC ..... Y10T 156/1795; Y10T 156/1348; Y10T 156/18; B65H 35/002; B65H 35/0026; B65H 35/0033; B65H 35/0073; B65H 35/008; B65H 35/0086; B65H 2301/5151; B65H 2301/5154; B65H 2403/941
USPC ..... 156/577, 523, 579
See application file for complete search history.

(56) References Cited

U.S. PATENT DOCUMENTS 1,498,618 A * 6/1924 Fritz ..... B44C 7/04 156/577
3,131,109 A * 4/1964 Auld ..... B65H 35/0053 156/579
4,555,298 A * 11/1985 Boucher ..... B44C 7/06 156/577
5,290,390 A 3/1994 Roman et al.
6,254,620 B1 * 7/2001 Koh ..... A61B 17/0467 30/280
7,011,238 B1 * 3/2006 Sung ..... B05C 17/0123 222/391
7,028,941 B2 4/2006 Ibrahim et al.
7,175,732 B2 2/2007 Robison et al.
(Continued)

OTHER PUBLICATIONS

Product Page for Builder Board Adhesive Seam Tape, retrieved on Aug. 12, 2024; accessed from: https://www.surfaceshields.com/adhesive-tape/builder-board-seam-tape/.

*Primary Examiner* — Evan H MacFarlane
(74) *Attorney, Agent, or Firm* — UB Greensfelder LLP; Brian E. Turung

(57) ABSTRACT

A seam tape tool configured to dispense a tape onto a top surface of a floor or surface protection material. The seam tape tool includes a frame, an optional handle connected to the rear of the frame, a tape holder rotatably connected to the frame, an application wheel connected to the frame, an optional tape guide positioned adjacent to the application wheel to maintain the position of dispensed tape relative to the application wheel, a tape cutter arrangement movably mounted to the frame, an optional cutter guide to guide the movement of the tape cutter arrangement relative to the frame, an optional lock arrangement configured to lock the tape cutter arrangement in a retracted non-cut position, a cutter movement arrangement to move the tape cutter arrangement from the retracted non-cut position to the extended cut position, an optional cutter handle, and an optional base slide or base wheel arrangement.

7 Claims, 11 Drawing Sheets

(56) References Cited

U.S. PATENT DOCUMENTS

| | | | | |
|---|---|---|---|---|
| 2001/0026998 | A1 | 10/2001 | Moore et al. | |
| 2005/0051278 | A1* | 3/2005 | Dobson | E04F 21/00 156/574 |
| 2006/0226168 | A1 | 10/2006 | Henegar | |
| 2007/0125475 | A1 | 6/2007 | Cecilio et al. | |
| 2011/0308708 | A1* | 12/2011 | Sternau | E04F 21/1657 156/538 |
| 2014/0263528 | A1* | 9/2014 | Ormerod | B65H 35/008 225/77 |

* cited by examiner

SEAM TAPE TOOL

The present disclosure claims priority on U.S. Provisional Application Ser. No. 63/161,188 filed Mar. 15, 2021, which is incorporated herein by reference.

The present disclosure sets forth an exemplary seam tape tool configured to apply a seam tape or other type of tape to a floor protection material. However, it is to be appreciated that a seam tape tool in accordance with the present disclosure is also amenable to enable a tape to be applied to other types of materials.

BACKGROUND

There are currently several types of tape dispensers used to dispense tape on a variety of products. One type of tape dispenser is used to connect together two or more sheets of floor protection material. One such type of tape dispenser is offered by Surface Shields under the mark BUILDER BOARD™ SEAMER. Although such a tape dispenser allows a user to conveniently walk along the top of a floor protection material and dispense a seam tape to connect two or more sheets of floor protection material together, such tape dispenser is configured for use in larges areas, and such tape dispenser requires a separate device to cut the seam tape. As such, for smaller locations such as stairs, counter tops, etc., and for areas located on a ground surface (e.g., walls), the tape dispenser is not as convenient to use. Also, the need to bend down and cut the tape can be inconvenient and increase the application time.

Prior art tape dispensers also can be difficult to use when the tape needs to be cut after application of the tape. These tape dispensers typically include a cutting edge that has a uniformly shaped cutting edge that is equal to or slightly greater than a width of the tape. When the tape is to be cut, the user must tilt or otherwise position the tape dispenser to cause the tape to engage the tape cutter. Due to the configuration of the tape cutter and the location of the tape cutter on the dispenser, it can be difficult to cut the seam tape by the dispenser. It is common that a knife or scissors are used by the user to properly cut the tape after use of the dispenser.

In view of the current state of tape dispensers for use in securing pieces of surface protector together or securing a surface protector to various types of surfaces, there is need for an improved tape dispenser that is easy to use, convenient for cutting seam tape and other types of tape, easy to manufacture, and cost effective to manufacture.

BRIEF DESCRIPTION

In accordance with one non-limiting aspect of the present disclosure, there is provided a seam tape tool that is configured to dispense a seam tape onto a top surface of a floor or surface protection material. The seam tape tool can be used to secure together two or more pieces of surface protection material; and/or secure one or more pieces of surface protection material to various types of surfaces (e.g., floor, wall, countertop, stairs, etc.). Although the seam tape tool will be particularly described with reference to applying a seam tape to a surface of a surface protection material, it will be appreciated that the seam tape tool can be used to dispense other types of tape (e.g., masking tape, duct tape, butyl tape, etc.), and that the various types of tapes can be applied to surfaces other than a surface protection material (e.g., floors, decks, roofs, steps, materials other than surface protection materials, etc.). As such, the present disclosure is not limited to a tape tool that can only be used to dispense seam tape onto the surface of a surface protection material.

The seam tape tool in accordance with the present disclosure is configured to easily and conveniently dispense a tape onto a floor protection material and then sever or cut the tape when required.

The seam tape tool in accordance with one non-limiting aspect of the present disclosure includes a frame, an optional handle connected to the rear of the frame, a tape holder rotatably connected to the frame, an application wheel connected to the frame and wherein the application wheel is optionally configured to rotated relative to the frame, an optional tape guide positioned adjacent to the application wheel to maintain the position of dispensed tape relative to the application wheel, a tape cutter arrangement movably mounted to the frame, an optional cutter guide to guide the movement of the tape cutter arrangement relative to the frame, an optional lock arrangement configured to lock and unlock said the tape cutter arrangement in said retracted non-cut position, an optional cutter movement arrangement configured to move the tape cutter arrangement from the retracted non-cut position to the extended cut position when the tape cutter arrangement is unlocked from the lock arrangement, and wherein the cutter movement arrangement optionally includes a cutter handle and an optional base slide or base wheel arrangement to facilitate in the movement of the seam tape tool over a floor surface.

In accordance with another and/or alternative non-limiting aspect of the present disclosure, the frame is generally formed from a durable material (e.g., plastic, metal, composite material, wood, etc.). The size and shape of the frame is non-limiting. The size and weight of the frame is such that an individual can easily lift and move the frame. Generally, the frame has a volume of about 150-750 cubic inches (and all values and ranges therebetween), and has a weight of about 0.25-10 lbs. (and all values and ranges therebetween).

In accordance with another and/or alternative non-limiting aspect of the present disclosure, there is provided a handle that is connected to the frame and is configured for easy grasping by a user. The handle can optionally include a grip (e.g., plastic material, rubber material, etc.) to facilitate in the gripping of the seam tape tool. The handle can be any material (e.g., plastic, metal, composite material, wood, etc.), shape (e.g., tubular-shaped, rod-shaped, etc.), configuration, and/or length. In one non-limiting arrangement, the handle can be configured so that a user must bend over or be on his/her knees when applying a tape to a surface. In such a configuration, the handle is generally 3-20 inches (and all values and ranges therebetween) in length and is configured to be grasped by a single hand of the user. In another non-limiting arrangement, the handle can be configured so that a user can stand and walk along a surface when applying a tape to a surface. In such a configuration, the handle is generally 25-80 inches (and all values and ranges therebetween) in length and is optionally configured to be grasped by a single hand of the user. The handle can be permanently or removably connected to the frame. As can also be appreciated, both types of handles can be simultaneously connected to the frame, or be interchangeably connected to the frame. An attachment arrangement (e.g., screw, pin, clamp, bolt, etc.) can optionally be used to releasably secure the handle to the frame.

In accordance with another and/or alternative non-limiting aspect of the present disclosure, there is provided a tape holder that is configured to allow for easy insertion and removal of a roll of tape from the tape holder. The shape (e.g., cylindrical shaped, triangular shaped, square shaped, etc.), material (e.g., plastic, metal, composite material, wood, etc.), size, and configuration of the tape holder is non-limiting. In one non-limiting embodiment, the tape holder is rotatably connected to the frame to rotate as tape is dispensed from the roll of tape. The tape holder is generally located on the top portion of the frame; however, this is not required. The tape holder is generally positioned on the frame such that when a full roll of tape is inserted onto the tape holder, the roll of tape can rotate on the tape holder when being dispensed from the seam tape tool.

In accordance with another and/or alternative non-limiting aspect of the present disclosure, there is provided an application wheel that is configured to facilitate in applying and pressing a tape to a surface as the tape is dispensed from the seam tape tool. The application wheel has a generally circular cross-sectional shape along a majority or the full longitudinal length of the application wheel. The material (e.g., plastic, metal, composite material, wood, etc.), size, and configuration of the application wheel is non-limiting. When the application wheel has a generally circular cross-sectional shape along a majority or the full longitudinal length of the application wheel, the diameter of the circular cross-sectional shape is generally 0.5-5 inches (and all values and ranges therebetween). Generally, the application wheel is positioned on the front portion of the frame and is rotatably connected to the frame. Generally, the application wheel is configured to rotate as the tape tool is moved over the top surface of the surface protection material and as the tape is applied to the top surface of the surface protection material to thereby facilitate in securing the tape to the top surface of the surface protection material or some other top surface. The application wheel can optionally be used to facilitate in pressing the tape against the top surface of a surface protection material or other surface as the tape is dispensed from the roll of tape. Generally, the width of the application wheel is the same or greater than the width of the tape being dispensed from the seam tape tool; however, this is not required. The outer surface of the application wheel is generally a smooth surface to facilitate in the uniform application of the tape to the top surface of the surface protection material or some other top surface; however, this is not required. In one non-limiting configuration, at least a portion of the application wheel is positioned under a full roll of tape positioned on the tape holder, and optionally also under a portion of the tape holder. Such a positioning of the application wheel relative to the tape and optionally the rape holder facilitates in the ease and proper dispensing of the tape to the top surface of the surface protection material or some other top surface.

In accordance with another and/or alternative non-limiting aspect of the present disclosure, there is provided an optional tape guide positioned adjacent to the application wheel to maintain the position of dispensed tape relative to the application wheel. The tape guide can optionally include one or more arms. The one or more arms can optionally be configured to partially extend above the surface of the application wheel. The tape guide is used to at least partially guide the tape that is dispensed from the roll of tape to the application wheel as the seam tape tool is moved over the top surface of the surface protection material and the tape is applied to the top surface of the surface protection material. The material (e.g., plastic, metal, composite material, wood, etc.), size, shape, and configuration of the tape guide is non-limiting. When at least a portion of the tape guide is positioned over the application wheel, the gap between the portion of the tape guide is positioned over the application wheel is at generally 1.2-20 times (and values and ranges therebetween) of the thickness of the tape.

In accordance with another and/or alternative non-limiting aspect of the present disclosure, there is provided a tape cutter arrangement that is configured to cut the tape. The material (e.g., plastic, metal, composite material, wood, etc.), size, shape, and configuration of the tape cutter arrangement is non-limiting. In one non-limiting configuration, the tape cutter arrangement incudes a cutter blade that has a lead cut edge and optional angled cutting surfaces that extend outwardly and rearwardly from the lead cut edge. The lead cut edge of the cutter blade (when used) facilitates in initially punching through the tape, thereby facilitating in the subsequent cutting through of the remainder of the tape by the outwardly extending portions of the cutter blade. Such a cutter blade configuration provides improved cutting of the tape as compared to a tape cutter that has a uniformly shaped cutting edge. In one non-limiting arrangement, the maximum width of the lead cut edge is 2-50% (and all values and ranges therebetween) the maximum width of the cutter blade. In another non-limiting arrangement, the longitudinal length of the lead cut edge is 2-50% (and all values and ranges therebetween) the longitudinal length of the cutter blade. In another non-limiting arrangement, at least a portion of the lead cut edge is oriented along the longitudinal centerline of the cutter blade (e.g., lead cut edge centered along the longitudinal centerline of the cutter blade, etc.). In another non-limiting arrangement, the front-end portion of the lead cut edge has a generally V-shaped configuration. In one design, the cutter blade includes a lead cut edge that has a front end portion with a generally V-shaped configuration, and generally straight rearward portions that have sides that are generally parallel to one another, and then outwardly extending portions that extend rearwardly from the generally straight rearward portions and extend outwardly to generally the maximum width of the cutter blade, and the longitudinal length of the lead cut edge is 2-25% (and all values and ranges therebetween) the longitudinal length of the cutter blade, the longitudinal length of the generally straight rearward portions is 2-25% (and all values and ranges therebetween) the longitudinal length of the cutter blade, and the longitudinal length outwardly extending portions is 5-90% (and all values and ranges therebetween) the longitudinal length of the cutter blade, and generally the longitudinal length of the lead cut edge is less than the longitudinal length of the generally straight rearward portions, and the longitudinal length of the outwardly extending portions is generally greater than the longitudinal length of the lead cut edge and also optionally greater than the longitudinal length of the generally straight rearward portions. As can be appreciated, the generally straight rearward positions do not need to be parallel to one another, but can extend both rearwardly and outwardly from the lead cut edge. If the generally straight rearward positions do extend outwardly, generally the generally straight rearward positions have an outward angle that is less than the outward angle of the outwardly extending portions. The average thickness of the cutter blade is generally 0.02-0.5 inches (and all values and ranges therebetween), and the average thickness of the cutter blade can optionally constitute 50-90%+ (and all values and ranges therebetween) of the cutter blade. In another non-limiting configuration, all or a portion of the front edge of the cutter blade has a sloped edge that forms a sharp edge end that facilitates in the cutting of the tape. The tape cutter arrangement can optionally include a cutter extension that is connected to the rear portion of the cutter blade. The shape, size, and configuration of the cutter extension (when used) is non-limiting. In one non-limiting configuration, the longitudinal length the cutter blade is equal to or less than the longitudinal length of the cutter extension; however, this is not required.

In accordance with another and/or alternative non-limiting aspect of the present disclosure, there is provided a tape cutter arrangement that is configured to be movably mounted to the frame. In such an arrangement, the tape cutter arrangement is configured to move between a cut and non-cut position. In one non-limiting configuration, the tape cutter arrangement is configured to cut the tape when the tape cutter moves from a retracted non-cutting position to an extended cut position. When the tape cutter arrangement is in the retracted non-cutting position, the tape can be dispensed from the seam tape tool without contacting the tape cutter arrangement. When tape is to be cut, the tape cutter arrangement is moved to the extended cut position to cut the tape. After the tape is cut, the tape cutter arrangement can be moved back to the non-cut position so that the tape can again be dispensed from the seam tape tool. In one non-limiting design, the tape cutter arrangement can be manually moved between the non-cutting position and/or the extended cut position. In another non-limiting design, the tape cutter arrangement can be semi-automatically or automatically moved between the non-cutting position and/or the extended cut position. In another non-limiting design, the tape cutter arrangement can be manually moved to the non-cutting position and a release mechanism can be used to move the tape cutter arrangement to the extended cut position.

In accordance with another and/or alternative non-limiting aspect of the present disclosure, there is optionally provided a lock arrangement that includes a lock system to releasably lock the tape cutter arrangement in the non-cutting position. In one non-limiting configuration, the lock system includes a tab and bar arrangement wherein one or more tabs releasably engage a movable bar. When the bar is on the locked position, the bar engages and retains the one or more tabs in position relative to the bar. The one or more tabs (when used) are located on the rear portion of the tape cutter arrangement. As can be appreciated, slots, flanges, etc., can be to used instead of the one or more tabs. When the bar is moved (e.g., pivots, raised, lowered, etc.) to the release position, the one or more tabs are allowed to disengage from the bar. As can be appreciated, the lock system can have other arrangements that can be used to releasably lock the tape cutter arrangement in the non-cutting position after the tape cutter arrangement.

In accordance with another and/or alternative non-limiting aspect of the present disclosure, there is optionally provided a cutter movement arrangement that is configured to move the tape cutter arrangement from the retracted non-cut position to the extended cut position when the tape cutter arrangement is unlocked from the lock arrangement. The cutter movement arrangement can optionally include a biasing system (e.g., mechanical spring, gas spring, etc.) that can optionally be used to move the tape cutter arrangement from the non-cutting position to the extended cut position when the lock arrangement allows the tape cutter arrangement to move from the non-cutting position to the extended cut position. The biasing system (when used) can cause the tape cutter arrangement to accelerate from the non-cutting position to the extended cut position, thereby causing the tape cutter arrangement to strike the tape at a speed to facilitate in the cutting of the tape. When the tape cutter arrangement includes the optional lead cut edge, the accelerated movement of the tape cutter arrangement to the extended cut position can cause the lead cut edge to punch or pierce through the tape to thereby facilitate in the cutting of the tape. When the tape cutter arrangement is configured to be accelerated from the non-cutting position to the extended cut position, the speed of the tape cutter arrangement as it first engages the tape or just before it reaches the extended cut position is about 5-250 inches per second (and all values and ranges therebetween) or has an average acceleration of 1-20 inches per second squared (and all values and ranges therebetween). In one specific non-limiting design, the tape cutter arrangement slides between the non-cutting position and the extended cut position by use of one or more mechanical springs In accordance with another and/or alternative non-limiting aspect of the present disclosure, there is optionally provided a cutter guide that is located on the frame to facilitate in guiding and maintaining the tape cutter arrangement in position relative to the frame and facilitates in preventing the tape cutter arrangement from disengaging from the frame when the tape cutter arrangement moves between the non-cutting position and the extended cut position. The cutter guide is generally positioned on the bottom of the frame; however, this is not required. The cutter guide can optionally be in the form of one or more slots that at least partially receive a portion of one or both side edges of the tape cutter arrangement and guide the movement of the tape cutter arrangement relative to the frame. When the tape cutter arrangement is moved to the non-cutting position, the one or more optional mechanical springs are caused to be extended and placed in tension. When the lock arrangement allows the tape cutter arrangement to move from the non-cutting position to the extended cut position, the one or more optional mechanical springs cause the tape cutter arrangement to move and accelerate toward the front of the frame and to cause the tape cutter arrangement to engage and cut the tape. The tape cutter arrangement can optionally include one or more stops that prevent the over retraction and/or extension of the tape cutter arrangement relative to the frame when the tap cutter moves between the non-cutting position and the extended cut position.

In accordance with another and/or alternative non-limiting aspect of the present disclosure, there is optionally provided a cutter handle that is used to move the tape cutter arrangement between the non-cutting position and/or the extended cut position. The cutter handle can be located on any location on the frame of the seam tape tool. In one non-limiting design, the cutter handle is located on one or both sides of the frame. In another non-limiting design, the cutter handle is located on the top surface of the tape cutter arrangement. The cutter handle enables a user to grasp the cutter handle to cause the tape cutter arrangement to be retracted back into the frame to the retracted non-cutting position. The size, shape, and configuration of the cutter handle is non-limiting. When the cutter handle is located on one or both sides of the frame, the frame can optionally include a slot wherein a portion of the cutter handle moves to partially guide the movement of the cutter handle relative to the frame. The cutter handle can be connected at one end to the tape cutter arrangement. In one non-limiting design, the cutter blade arrangement is connected to a cutter extension, one end of the cutter handle is connected to the cutter extension, a portion of the cutter handle extends through a slot in the frame and a portion of the cutter handle extends outwardly from the frame to be grasped by a user. Such portion of the cutter handle includes a grip to facilitate in the gripping of the cutter handle by a user. In another non-limiting design, one end of the cutter handle is connected to the top surface of the cutter extension.

In accordance with another and/or alternative non-limiting aspect of the present disclosure, there is provided lock arrangement that optionally includes a release button that is located on the bottom rear of the frame. The release button is configured to cause the lock arrangement to release the tape cutter arrangement from the locked position when the tape cutter arrangement is in the non-cutting position. The release button can be optionally biased (e.g., biased by a mechanical spring, gas spring, etc.) in a locked position. The release button can be configured to be pressed by a user or pushed against a surface (e.g., floor surface, countertop surface, etc.) to cause the release button to cause the locking arrangement to release the tape cutter arrangement from the locked position when the tape cutter arrangement is in the non-cutting position. In one non-limiting design, the release bottom is biased in an extended position when the lock arrangement is in the locked position. The release button is located on the rear and bottom portion of the frame so that a user can tilt the frame downwardly at the rear of the frame to cause the release bottom to be depressed, thereby causing the locking arrangement to be move to the unlocked position and releasing the tape cutter arrangement so that the tape cutter arrangement can move from the non-cutting position to the extended cut position. The release button can optionally be partially or fully housed in a button housing. The base of the release button can optionally include a bottom portion formed of a plastic, ceramic, composite, or metal material. When the use raises the back end of the frame, the biased release button moves to the extended position to cause the locking arrangement to move to the locking position. When the user causes the tape cutter arrangement to be moved from the extended cut position to the fully retracted non-cutting position, the tape cutter arrangement engages the locking arrangement while in the locked position to retain the tape cutter arrangement in the non-cutting position. As can be appreciated, the release button can be located on other or additional locations on the frame. As also can be appreciated, other arrangements can be used to allow the tape cutter arrangement to move to the extended cut position to cut the tape.

In accordance with another and/or alternative non-limiting aspect of the present disclosure, there is provided an optional base slide or base wheel arrangement to facilitate in the movement of the seam tape tool over a floor surface. The base slide or base wheel arrangement is generally located at the bottom portion of the frame and at or near the front portion of the frame. Generally, the base slide or base wheel arrangement is secured in position relative to the frame. When a base wheel arrangement is used, the base wheel arrangement can include one or more wheels. The one or more wheels can be rotatably or non-rotatably connected to the frame. The diameter of the one or more wheels (when used) are generally 0.5-4 inches (and all values and ranges therebetween). When a base slide is used, the base slide can optionally include a curved bottom portion that is configured to engage a floor surface, surface protection surface, etc., as the base slide is slid over such surface during the application of the tape to such surface. The diameter of curvature of the one or more base slides (when used) are generally 0.5-4 inches (and all values and ranges therebetween). In one non-limiting configuration, the optional base slide or base wheel arrangement can be connected to the cutter guide and the tape cutter arrangement moves between the bottom of the frame and the optional base slide or base wheel arrangement. In another non-limiting configuration, a portion of the biasing system can be connected to the optional base slide or base wheel arrangement, or pass above or partially or fully through the optional base slide or base wheel arrangement.

In accordance with another and/or alternative non-limiting aspect of the present disclosure, the seam tape tool is configured to be a smaller sized tool to enable a user to use the seam tape tool with a single hand; however, this is not required. The seam tape tool can optionally be configured to be used with an extended handle so that the seam tape tool can be moved along a surface as the user walks along the surface. When the seam tape tool includes an extended handle, the extended handle is generally connected to the rear of the frame; however, this is not required.

These and other objects and advantages will become apparent from the discussion of the distinction between the disclosure and the prior art and when considering the non-limiting embodiment illustrated in the accompanying drawings.

BRIEF DESCRIPTION OF THE DRAWINGS

Reference may now be made to the drawings, which illustrate at least one embodiment that the disclosure may take in physical form and in certain parts and arrangement of parts wherein.

DETAILED DESCRIPTION

Figure 1:
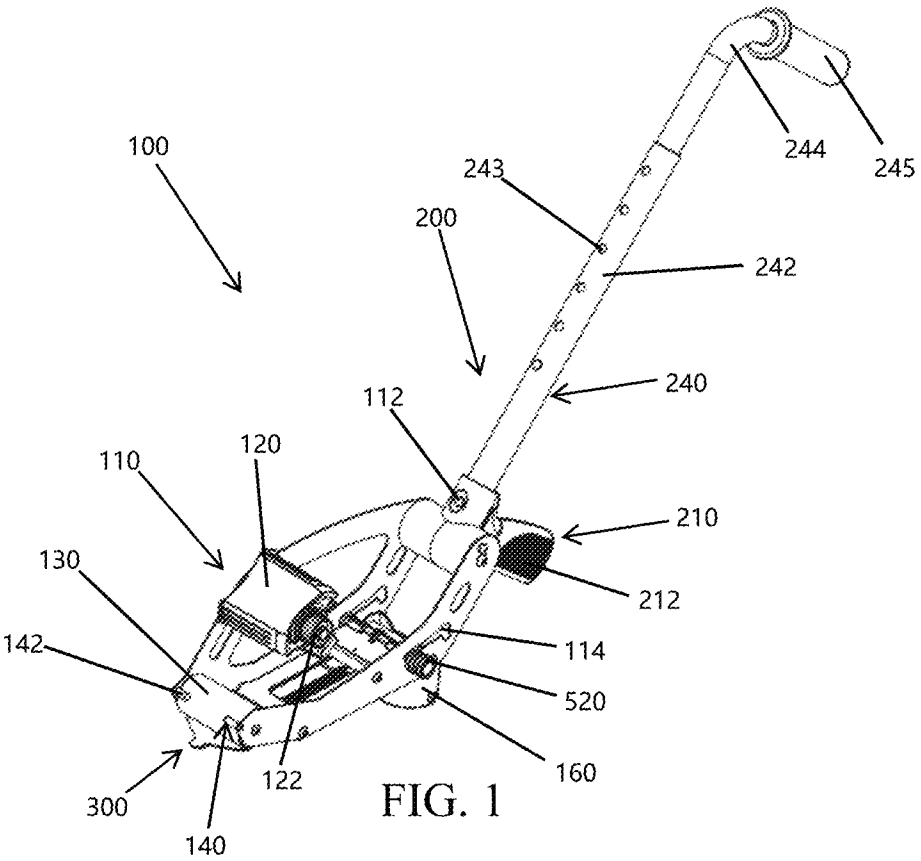
FIG. 1 is front elevation view of a non-limiting embodiment of the seam tape tool in accordance with the present disclosure wherein the tape cutter arrangement is in the extended cut position.
Figure 2:
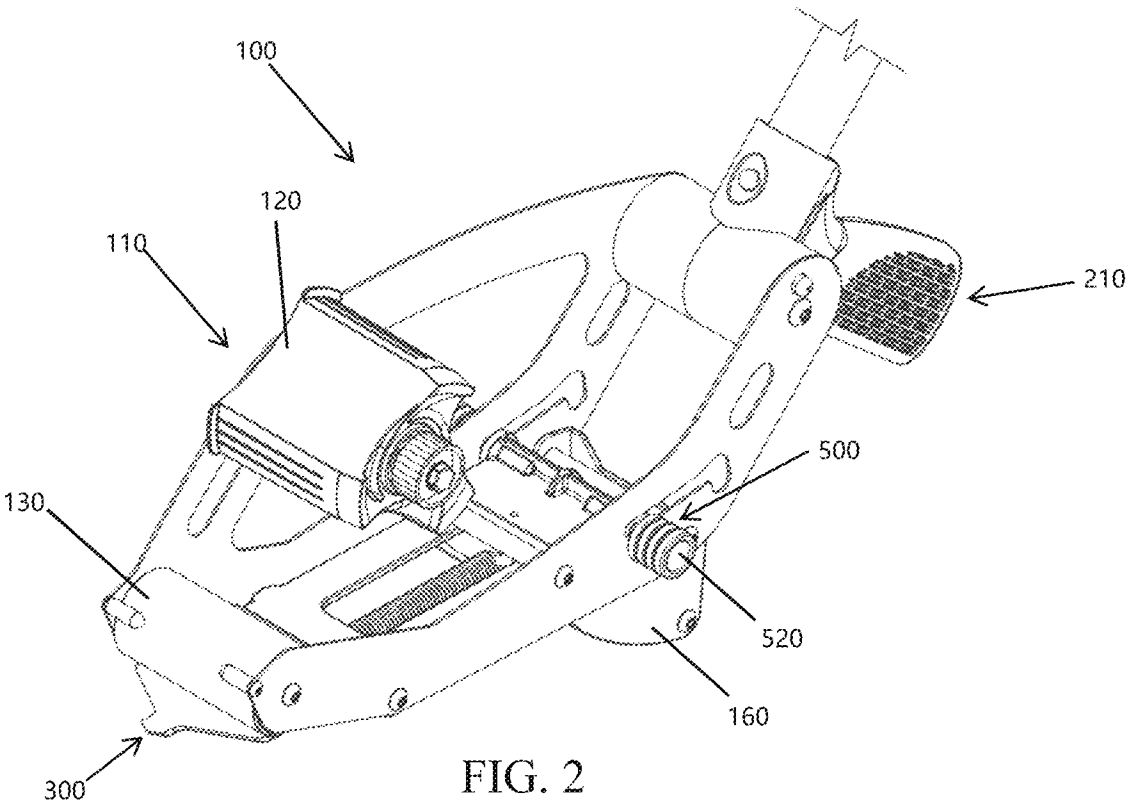
FIG. 2 is an enlarged view of the bottom portion of the seam tape tool as illustrated in FIG. 1.
Figure 3:
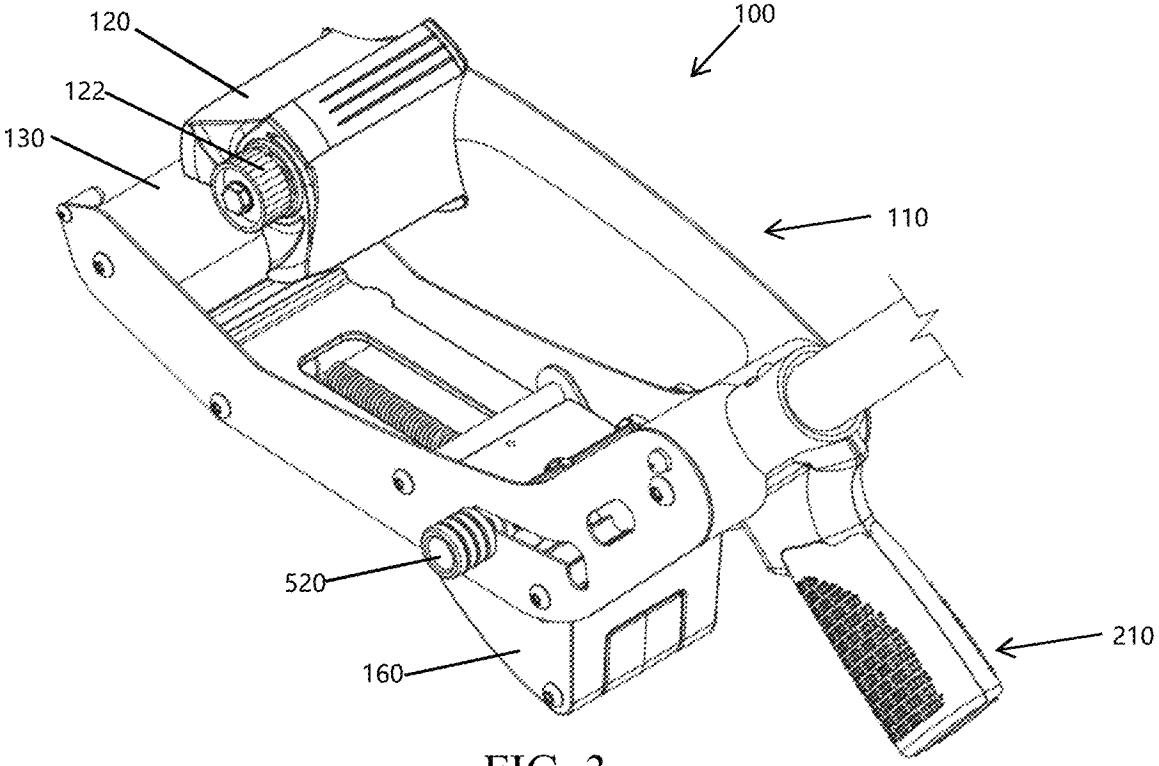
FIG. 3 is another enlarged view of the bottom portion of the seam tape tool as illustrated in FIG. 1.
Figure 4:
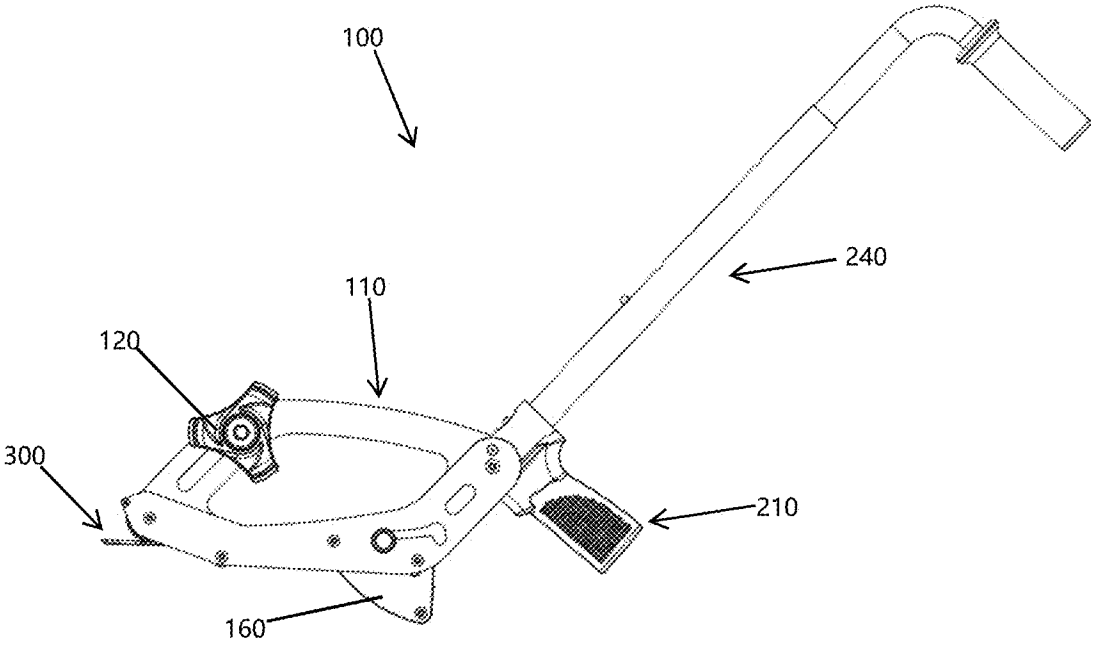
FIG. 4 is a right side view of the seam tape tool as illustrated in FIG. 1.
Figure 5:
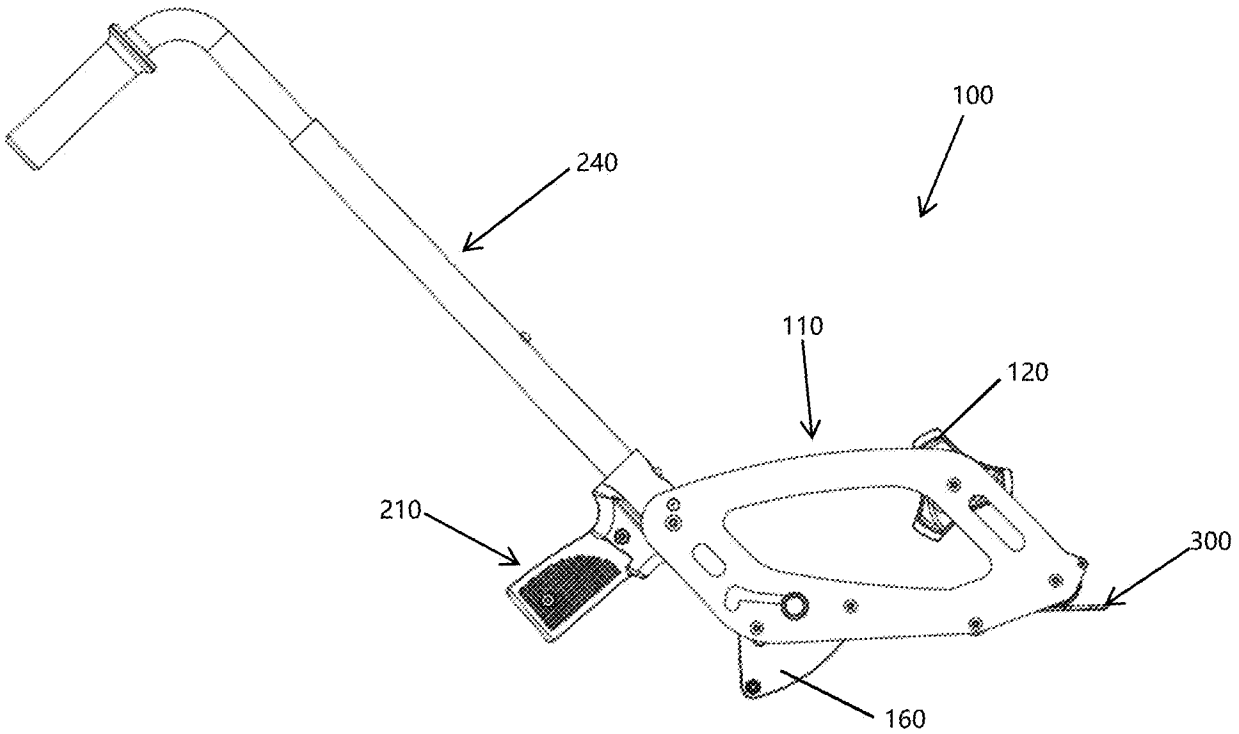
FIG. 5 is a left side view of the seam tape tool as illustrated in FIG. 1.

A more complete understanding of the articles/devices, processes and components disclosed herein can be obtained by reference to the accompanying drawings. These figures are merely schematic representations based on convenience and the ease of demonstrating the present disclosure and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" may be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Referring now to the drawings, wherein the showings are for the purpose of illustrating non-limiting embodiments of the disclosure only and not for the purpose of limiting the same, FIGS. 1-10 illustrate a non-limiting embodiment of the present disclosure directed to a seam tape tool 100 that can be used to easily and conveniently dispense tape onto the top surface of a surface protection material.

As illustrated in FIGS. 1-8, the seam tape tool 100 includes a frame 110 having a handle arrangement 200 connected to the rear portion of frame 110, a tape holder 120 that is optionally rotatably connected to frame 110, an application wheel 130 that is optionally rotatably connected to frame 110, a tape guide 140 positioned adjacent to application wheel 130, a tape cutter arrangement 300 movably mounted (e.g., slidably mounted) to the bottom of frame 110, a cutter handle 520 to enable a user to move tape cutter arrangement 300 to a locked position, and a bottom cutter release member 160 located on the bottom portion of frame 110 to cause tape cutter arrangement 300 to be unlocked and move to a unlocked/tape cutting position.

Frame 110 is generally formed from a durable material (e.g., plastic, metal, composite material, wood, etc.). The size and shape of frame 110 are non-limiting.

Handle arrangement 200 is configured for easy grasping by a user. Handle arrangement 200 can be in the form of a short handle 210 that is connected to the rear portion of frame 110, and/or an extension handle 240 that is connected to the rear portion of frame 110.

As illustrated in FIG. 1, seam tape tool 100 includes both a short handle 210 and an extension handle 240 that is connected to the rear portion of frame 110; both handles are not required. Short handle 210 has a short handle body 212 that is configured to be grasped by the user. At least a portion of short handle body 212 can optionally include a grip (e.g., plastic material, rubber material, etc.) to facilitate in the gripping of short handle body 212.

Extension handle 240 can be used to enable a user to walk along a floor surface while seam tape tool 100 applies tape to a floor surface or a material on a floor surface. Extension handle 240 includes an extended handle body section 242 and an extension handle 244. Extended handle body section 242 can have a tubular shape; however, other shapes can be used. The length of extension handle 240 and extended handle body section 242 are non-limiting. The bottom portion of extended handle body section 242 is connected rear portion of frame 110 by a connection arrangement 112. The type of connection arrangement is non-limiting (e.g., bolt, clamp, weld, solder, pin, rivet, screw, adhesive, threaded connection, etc.). Extended handle body section 242 can optionally include a cavity that can optionally telescopically receive a portion of extension handle 244. Alternatively, extension handle 244 can optionally include a cavity that can optionally telescopically receive a portion of extended handle body section 242. The length of extension handle 240 can optionally be adjustable. For example, when extended handle body section 242 and extension handle 244 are telescopically interconnected, extended handle body section 242 and extension handle 244 can be movable with respect to one another to alloy the length of to extension handle 240 to be adjusted. Once the desired length of extension handle 240 is obtained, a locking arrangement can be used to secure extended handle body section 242 and extension handle 244 in position with respect to one another. The locking arrangement can be configured to permanently or releasably lock together extended handle body section 242 and extension handle 244. The locking arrangement can have many configurations (e.g., clamping arrangement, slot and depressable tab arrangement, bolt, pin, etc.). As illustrated in FIG. 1, extended handle body section 242 includes one or more holes 243 that can be used to receive a pin, screw, bolt, depressible tab, etc. to lock extension handle 244 in position relative to extended handle body section 242. Extension handle 244 can optionally include a grip 245 (e.g., plastic material, rubber material, etc.) to facilitate in the gripping of extension handle 244. Extension handle 244 can include a curved portion to facilitate in the gripping of extension handle 244; however, this is not required.

As can be appreciated, seam tape tool 100, absent extension handle 240 is configured to be a smaller sized tool to enable a user to use seam tape tool 100 with a single hand; however, this is not required. Seam tape tool 100, when used with extension handle 240, is configured to be used so that seam tape tool 100 can be moved along a surface as the user walks along the surface.

Tape holder 120 is configured to allow for easy insertion and removal of a roll of tape (not shown) from tape holder 120. The material, size and configuration of tape holder 120 is non-limiting. Tape holder 120 is optionally rotatably connected to frame 110 so as to rotate as tape is dispensed from the roll of tape. As illustrated in FIG. 1, tape holder 120 is illustrated as having a generally triangular shape; however, other shapes can be used (e.g., square, cylindrical, polygonal cross-sectional shapes, etc.).

An optional tape roll adjuster 122 can be used to a) adjust how freely tape holder 120 rotates relative to frame 110, and/or b) adjust that positioning of tape holder 120 on frame 110 to accommodate different roll sizes of tape. The rotation of the optional tape roll adjuster 122 can optionally be used to increase or reduce the resistance to rotation of tape holder 120 rotates relative to frame 110. As can be appreciated, other arrangements can be used to adjust how freely tape holder 120 rotates relative to frame 110. The rotation of optional tape roll adjuster 122 can also to alternatively be used to enable a user to move the position of tape holder 120 on frame 110 so as to accommodate different roll sizes of tape. Frame 110 can include one or more openings or slots to facilitate in the adjustment of the position of tape holder 120 on frame 110.

The optional tape roll adjuster 122 can also be removably connected to frame 110 so that upon removal, the tape holder can also be removed from frame 110; however, this is not required.

The front portion of frame 110 optionally includes an application wheel 130 that is used to facilitate in pressing the tape against the top surface of a surface (e.g., floor surface; countertop surface, stairs, surface protection material, etc.) as seam tape tool 100 is moved over a surface and the tape is dispensed from the roll of tape. Application wheel 130 is optionally rotatably connected to frame 110 to rotate as the seam tape tool is moved over the top surface of a surface and as the tape is applied to such surface. The shape of application wheel 130 is non-limiting. As illustrated in FIG. 1, application wheel 130 has a generally cylindrical shape; however, other shapes can be used. The type of material used to form application wheel 130 is non-limiting.

A tape guide 140 that is connected to the front portion of frame 110 is used to guide the tape that is dispensed from the roll of tape to application wheel 130 as seam tape tool 100 is moved over a top surface (e.g., floor surface; countertop surface, stairs, surface protection material, etc.) and the tape is applied to the top surface. Generally, at least a portion of the tape guide 140 is spaced from application wheel 130. Generally, the spacing is about 0.05-0.25 inches (and all values and ranges therebetween); however, other distances can be used. The size, shape, and configuration of the tape guide is non-limiting. Generally, at least a portion of a width of the tape (e.g., 5-100% and all values and ranges therebetween) is located between the tape guide 140 and application wheel 130 as the dispensed tape from the roll of tape moves past application wheel 130. Tape guide 140 can optionally include one or more guide arms 142. As illustrated in FIG. 1, tape guide 140 includes two guide arms 142 that partially extend above surface of application wheel 130. A guide arm 140 is located on each side of application wheel 130 and guide arms 140 are spaced from one another. The spacing between guide arms 142 facilitates in positioning the tape between guide arms 142 and application wheel 130.

Figure 6:
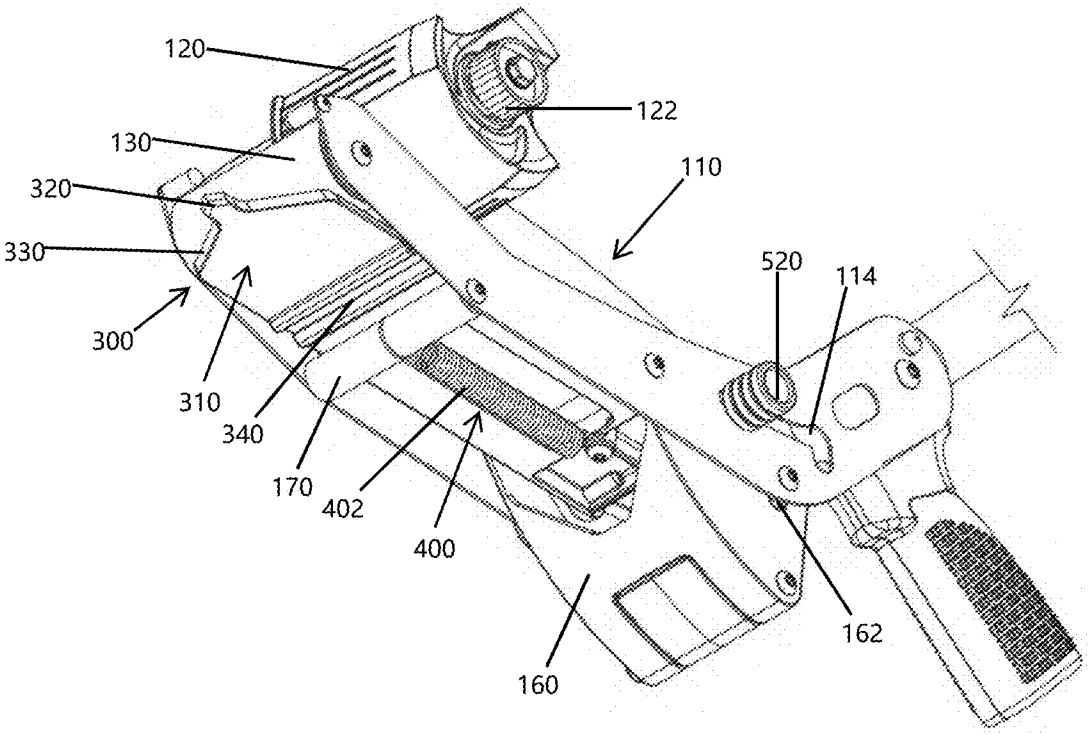
FIG. 6 is an enlarged bottom elevation view of the seam tape tool as illustrated in FIG. 1.
Figure 7:
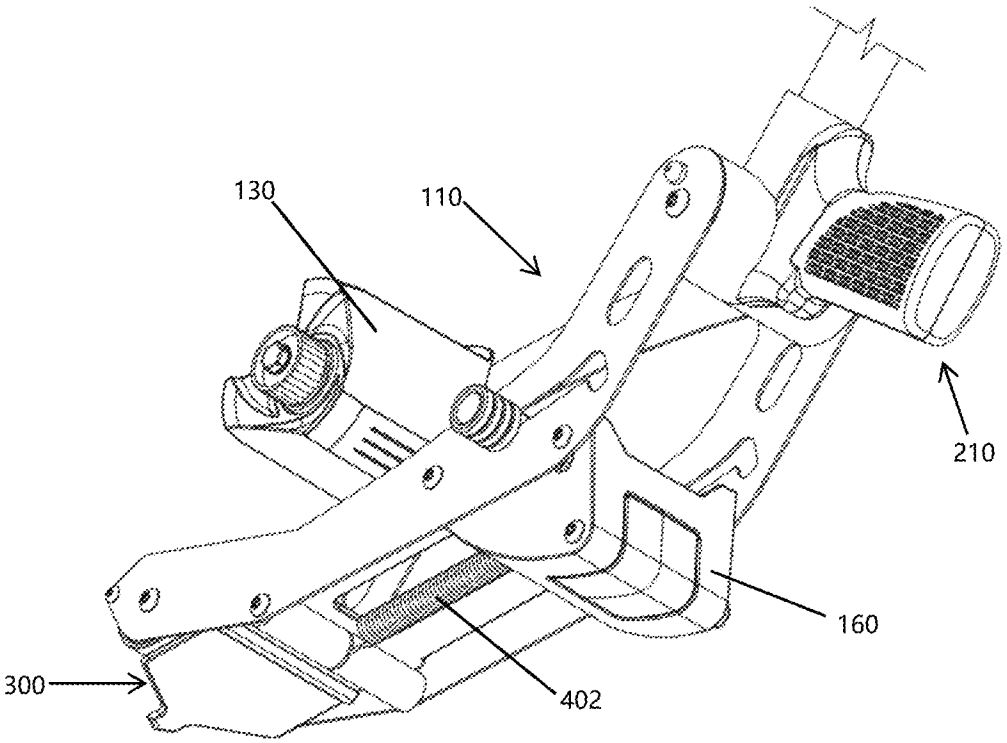
FIG. 7 is another enlarged bottom elevation view of the seam tape tool as illustrated in FIG. 1.

The tape cutter arrangement 300 is configured to cut the tape when the cutter moves from the retracted locked position (see FIG. 9) to the extended cut position (see FIG. 6). Tape cutter arrangement 300 is formed of a durable material such as, but not limited to, metal, plastic, ceramic, etc. As can be appreciated, the size and shape of the cutter is non-limiting.

The shape of tape cutter arrangement 300 is non-limiting. As illustrated in FIG. 1, tape cutter arrangement 300 includes cutter blade 310 that has an optional lead cut edge 320 and optional angled cutting surfaces 330 that extend outwardly and rearwardly from the lead cut edge 320. The lead cut edge 320 of the cutter blade 310 (when used) facilitates in initially punching through the tape, thereby facilitating in the subsequent cutting through of the remainder of the tape by the optional angled cutting surfaces 330 that extend outwardly and rearwardly from lead cut edge 310. Generally, lead cut edge 320 is oriented along the longitudinal centerline of the cutter blade; however, this is not required.

Tape cutter arrangement 300 is configured to move between a retracted non-cut position and an extended cut position. A cutter movement arrangement can be used to facilitate in the movement of tape cutter arrangement 300 to the retracted non-cut position and the extended cut position. The cutter movement arrangement optionally includes a biasing system 400 (e.g., mechanical spring, gas spring, etc.) that can optionally be used to move the tape cutter arrangement from the non-cutting position to the extended cut position. In one non-limiting arrangement, tape cutter arrangement 300 includes a spring 402. As illustrated in FIG. 6, the rear portion of tape cutter arrangement 300 is connected to one end of spring 402 and the other end of the spring is connected to frame 110 at a location forwardly of the rear portion of tape cutter arrangement 300. In one non-limiting arrangement, spring 402 is connected to a cross-bar 190 or other structure on frame 110. When tape cutter arrangement 300 is moved rearwardly to the retracted non-cut position, such movement causes the spring to be extended When tape cutter arrangement 300 is allowed to move from the retracted non-cut position to the extended cut position, the spring, when contracting to its natural non-extended position, facilitates in causing tape cutter arrangement 300 to move to the extended cut position.

Frame 110 optionally includes a guide slot arrangement 170 that facilitates in maintaining the position of tape cutter arrangement 300 relative to frame 110 as tape cutter arrangement 300 moves between the retracted non-cut position and the extended cut position. As illustrated in FIG. 6, guide slot arrangement 170 includes one or more rollers that are connected to a cross-bar 190 and/or other structure on frame 110. As can be appreciated, guide slot arrangement 170 can include other or additional structures on frame 110. The one or more rollers (when used) can optionally be configured to rotate. The bottom surface of the one or more rollers can be arcuate shaped to facilitate in the movement of seam tape tool 100 is moved over a surface. As can be appreciated, other or additional arcuate-shaped or non-arcuate shaped structures can be used to facilitate in the movement of seam tape tool 100 over a surface. When the one or more rollers are configured to rotate, the rollers can be configured to rotate on the surface as seam tape tool 100 is moved over the surface. When the one or more rollers are configured to not rotate, the rollers can be configured to slide on the surface as seam tape tool 100 is moved over a surface. As illustrated in FIG. 6, one end of spring 402 is connected to or between the two rollers; however, this is not required.

When tape cutter arrangement 300 is in the retracted non-cut position, application wheel 130 and optionally one or more structures on frame 110 (e.g., rollers of guide slot arrangement 170, other rollers or glides structures on frame 110, etc.) can be used to facilitate in the movement of seam tape tool 100 over a surface.

A bottom surface of tape cutter arrangement 300 can optionally include a landing arrangement 340 that is configured to releasably engage a structure on frame 110 when tape cutter arrangement 300 is in the retracted non-cut position. One non-limiting purpose of landing arrangement 340 is to facilitate in minimizing the movement of tape cutter arrangement 300 when in the retracted non-cut position. As illustrated in FIG. 6, landing arrangement 340 (when used) can optionally include one or more ribs or other structures extending downwardly from the bottom surface of tape cutter arrangement 300. Landing arrangement 340 as illustrated in FIG. 6 is configured to releasably engage a portion of the guide slot 170 (i.e., rollers) when tape cutter arrangement 300 is in the retracted non-cut position.

Figure 8:
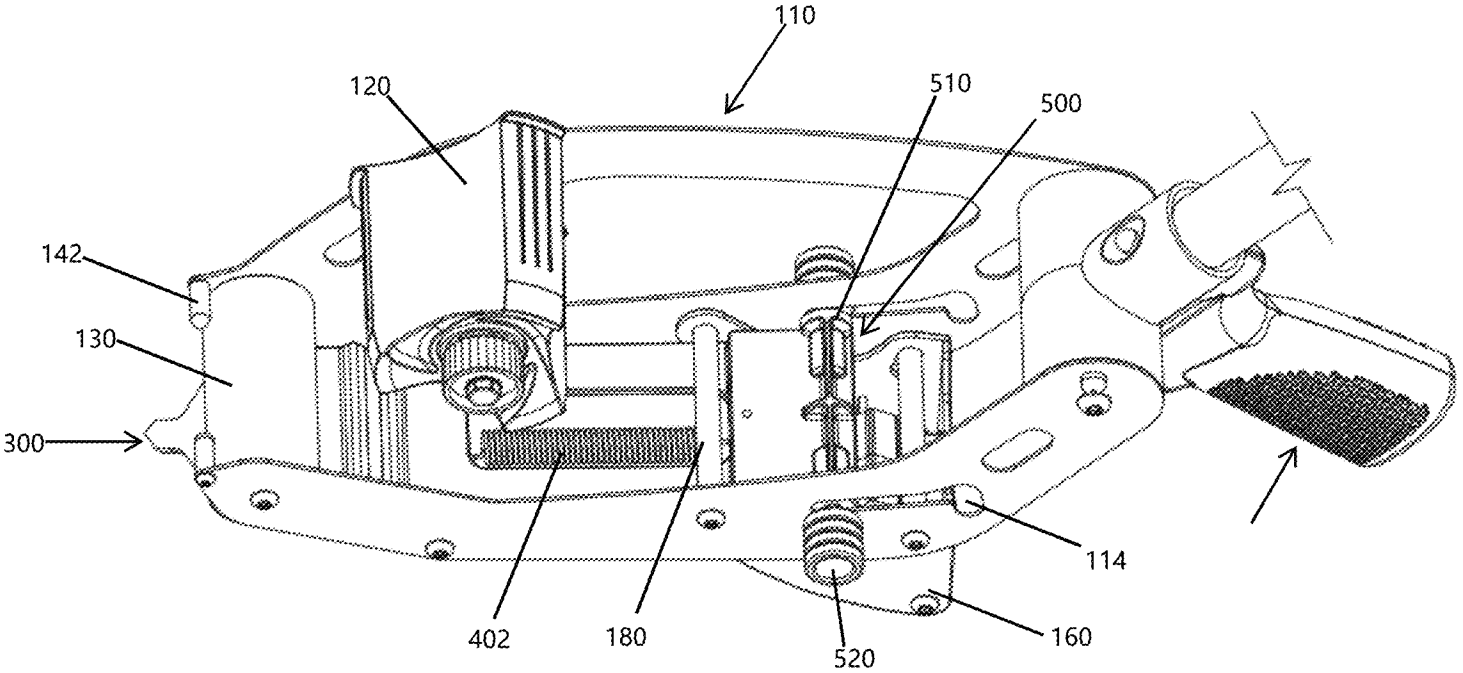
FIG. 8 is an enlarged top elevation view of the seam tape tool as illustrated in FIG. 1.

Frame 110 can optionally include a limit arrangement 180 configured to limit the forward movement of tape cutter arrangement 300 when moving from the retracted non-cut position to the extended cut position. As illustrated in FIG. 8, limit arrangement 180 includes a bar that functions a stop to a rear portion of tape cutter arrangement 300 to thereby limit the forward movement of tape cutter arrangement 300. Limit arrangement 180 can also or alternatively be used to maintain tape cutter arrangement 300 in position relative to frame 110 when moving between the retracted non-cut position to the extended cut position.

Figure 9:
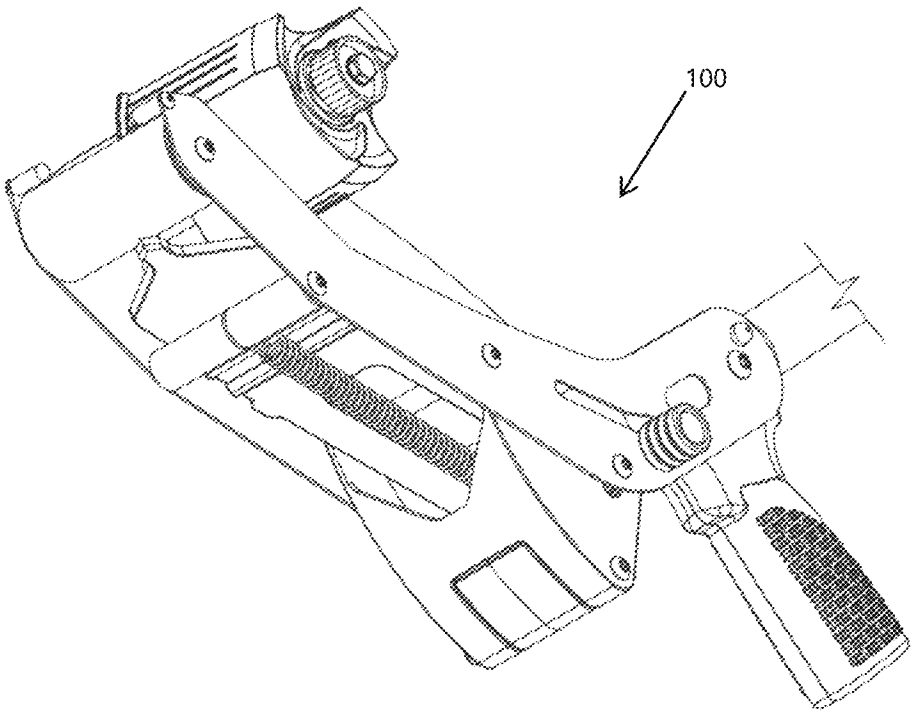
FIG. 9 in an enlarged bottom elevation view of the seam tape tool as illustrated in FIG. 1 wherein the tape cutter arrangement is in the retracted non-cut position.
Figure 10:
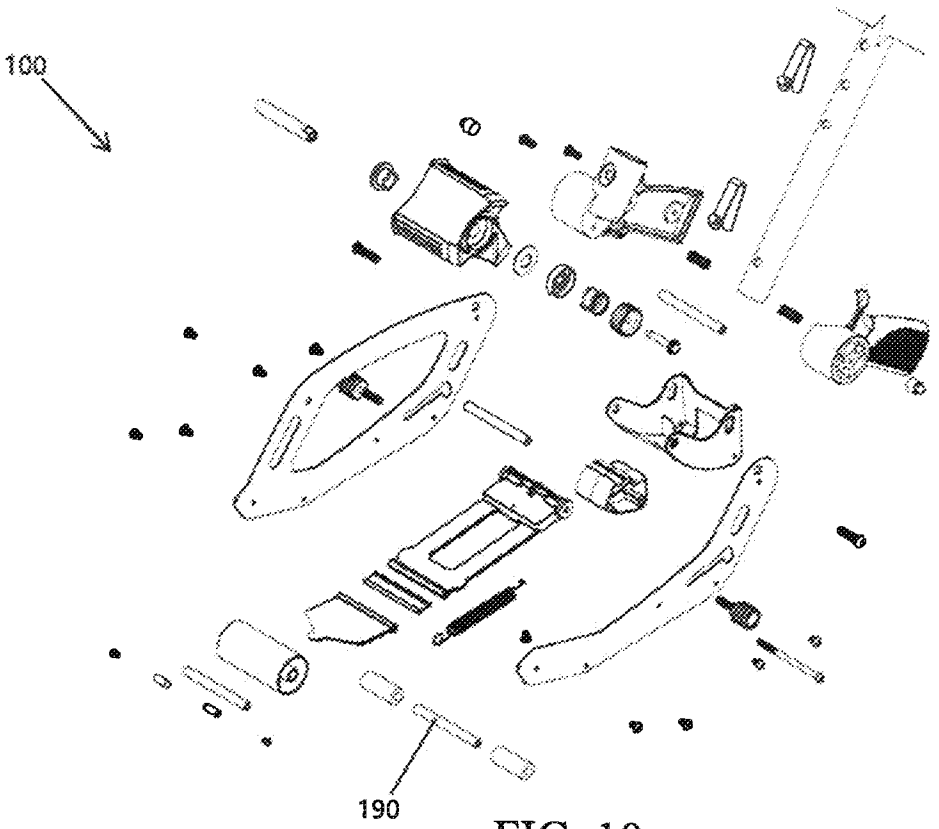
FIG. 10 is an exploded view of the seam tape tool as illustrated in FIG. 1 except for the full extension handle; and, FIG. 11 illustrates a method for using the seam tape tool.
Figure 11:
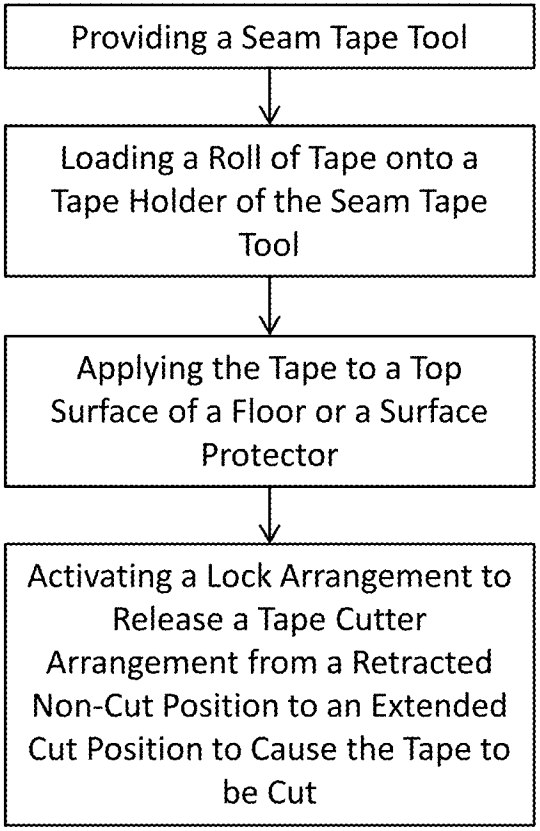

The rear portion of tape cutter arrangement 300 can include a cocking arrangement 500 that includes a bar or one or more flanges 510 and optionally one or more handles 520. The bar or one or more flanges 510 is generally connected to the rear portion of tape cutter arrangement 300. A portion of the bar or one or more flanges 510 extends through one or more locking slots 114. As illustrated in FIG. 1, handles 520 are connected to the ends of the bar or one or more flanges 510 and positioned on the exterior side of frame 110. In operation, a user can grasp a handle 520 on one or both sides of frame 110, and pull the handle(s) rearwardly to cause tape cutter arrangement 300 to more to the retracted non-cut position as illustrated in FIG. 9. The one or more locking slots 114 can include an end portion wherein a portion of the bar or one or more flanges 510 can be moved into so that the bar or one or more flanges 510 is retained in position, and represents the retracted non-cut position of tape cutter arrangement 300. As illustrated in FIG. 1, the rear portion of locking slots 114 is angled downwardly on the frame (e.g., 70-150° and all values and ranges therebetween) so that a portion of the bar or one or more flanges 510 can be moved into so that the bar or one or more flanges 510 is retained such location of locking slot 114. As can be appreciated, locking slot 114 can have other configurations.

The bar or one or more flanges 510 in combination with locking slot 114 can be used to facilitate in maintaining the position of tape cutter arrangement 300 relative to frame 110 as tape cutter arrangement 300 moves between the retracted non-cut position and the extended cut position. As such, the bar or one or more flanges 510 in combination with locking slot 114 and/or guide slot arrangement 170 can be used to facilitate in maintaining the position of tape cutter arrangement 300 relative to frame 110 as tape cutter arrangement 300 moves between the retracted non-cut position and the extended cut position.

The bottom cutter release member 160 is located at the bottom rear portion of the frame 110 and is configured to engage tape cutter arrangement 300 and/or cocking arrangement 500 to cause said cocking arrangement to release tape cutter arrangement 300 from the retracted non-cut position. In one configuration, bottom cutter release member 160 is movable relative to frame 110 to enable bottom cutter release member 160 to engage tape cutter arrangement 300 and/or cocking arrangement 500. Many arrangements can be used to enable bottom cutter release member 160 to be movable relative to frame 110 (e.g., pivot arrangement, slide arrangement, etc.). A limit slot arrangement 162 can optionally be used to limit the movement of the bottom cutter release member 160 relative to the frame 110.

Bottom cutter release member 160 can optionally be biased (e.g., spring biased, etc.) in a lower position, which lower position does not facilitate in bottom cutter release member 160 to engage tape cutter arrangement 300 and/or cocking arrangement 500 to cause said cocking arrangement to release tape cutter arrangement 300 from the retracted non-cut position. The size, shape, and configuration of bottom cutter release member 160 are non-limiting. In operation, a user can push downwardly on the frame to cause bottom cutter release member 160 to contact a floor surface and move toward tape cutter arrangement 300 and/or cocking arrangement 500 to cause the cocking arrangement to release tape cutter arrangement 300 from the retracted non-cut position. Once tape cutter arrangement 300 is released from the retracted non-cut position, tape cutter arrangement 300 is biased by biasing system 400 to move toward the extended cut position to cut the tape.

In operation, a user uses cocking arrangement 500 to move tape cutter arrangement 300 from the extended cut position (see FIG. 6) to the retracted non-cut position (see FIG. 9). While tape cutter arrangement 300 is in the retracted non-cut position, a user can move the seam tape tool along a surface and dispense tape from the seam tape tool. When the user wants to cut the tape, tape cutter arrangement 300 is caused to move from the retracted non-cut position to the extended cut position. Due to the biasing of tape cutter arrangement 300, tape cutter arrangement 300 rapidly moves from the retracted non-cut position to the extended cut position and thereby cuts the tape. Tape cutter arrangement 300 can be caused to move from the retracted non-cut position to the extended cut position by a) the user grasping one or more one or more handles 520 of cocking arrangement 500 and moving the bar or flanges 510 out of the rear portion of locking slot 114 so that tape cutter arrangement 300 can move forwardly to the extended cut position, and/or b) the user causes bottom cutter release member 160 to moving bar or flanges 510 out of the rear portion of locking slot 114 so that tape cutter arrangement 300 can move forwardly to the extended cut position.

The one or more exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed:

1. A method for applying a tape to a surface of a floor or to a surface protector that is positioned on a top surface of the floor comprising:

providing a seam tape tool configured to dispense said tape from a roll of tape, said seam tape tool comprising:

a frame;

a tape holder rotatably connected to said frame and configured to receive said roll of tape;

an application wheel connected to said frame;

a tape cutter arrangement having a cutter blade, wherein said tape cutter arrangement is movably mounted to said frame between a retracted non-cut position and an extended cut position;

a cocking arrangement having a) a first cutter handle extending perpendicularly through a slot formed in one side of said frame, or b) a first cutter handle extending perpendicularly through a first slot formed in one side of said frame and a second cutter handle extending perpendicularly through a second slot formed in another side of said frame, wherein said cocking arrangement is configured to lock and unlock said tape cutter arrangement in said retracted non-cut position;

a spring configured to move said tape cutter arrangement from said retracted non-cut position to said extended cut position when said tape cutter arrangement is unlocked from said cocking arrangement, said application wheel and said tape holder are positioned on said frame such that when said roll of tape is positioned on said tape holder at least a portion of said application wheel is positioned under the roll of tape; and one or more rollers connected to a cross-bar on said frame, wherein said one or more rollers are configured to facilitate in movement of said seam tape tool over the top surface of said floor or a top surface of the surface protector, wherein said one or more rollers are located on a bottom portion of said frame and at or near a front portion of the frame, wherein said one or more rollers include a curved surface configured to engage the top surface of said floor or the top surface of the surface protector, and wherein said one or more rollers or said cross-bar is connected to said spring;

loading said roll of tape onto said tape holder of said seam tape tool;

applying said tape to the top surface of said floor or to the top surface of said surface protector; and, activating said cocking arrangement to release said tape cutter arrangement from said retracted non-cut position to said extended cut position to cause said tape to be cut.

2. The method as defined in claim 1, further including a first handle and a second handle, both said first and second handles are connected to a rear portion of said frame, said first handle and said second handle are both configured for grasping by a user during use of said seam tape tool.

3. The method as defined in claim 1, wherein said tape holder is positioned upwardly and rearwardly of said application wheel.

4. The method as defined in claim 1, further including a tape guide positioned adjacent to said application wheel to maintain a position of said tape relative to said application wheel.

5. The method as defined in claim 1, wherein said cutter blade has a lead cut edge and outwardly extending portions positioned rearwardly of said lead cut edge, said lead cut edge has a V-shaped configuration, said lead cut edge having a narrowest width at a central region of said lead cut edge.

6. The method as defined in claim 1, said spring is positioned below said tape holder and said application wheel.

7. The method as defined in claim 1, said first cutter handle is movable along a longitudinal length of said frame, or b) said first and second cutter handles are simultaneously movable along a longitudinal length of said frame.

* * * * *